US006899504B2

(12) United States Patent
Kiyomi

(10) Patent No.: US 6,899,504 B2
(45) Date of Patent: May 31, 2005

(54) FASTENER

(75) Inventor: Takio Kiyomi, Osaka (JP)

(73) Assignee: Kokuyo Co., Ltd., Osaka (JP)

( * ) Notice: Subject to any disclaimer, the term of this patent is extended or adjusted under 35 U.S.C. 154(b) by 149 days.

(21) Appl. No.: 10/257,632

(22) PCT Filed: Apr. 11, 2002

(86) PCT No.: PCT/JP02/03628

§ 371 (c)(1),
(2), (4) Date: Oct. 16, 2002

(87) PCT Pub. No.: WO02/083428

PCT Pub. Date: Oct. 24, 2002

(65) Prior Publication Data

US 2003/0138308 A1 Jul. 24, 2003

(30) Foreign Application Priority Data

Apr. 12, 2001 (JP) ..... 2001-113952

(51) Int. Cl.[7] ..... B42B 5/06

(52) U.S. Cl. ..... 412/34; 281/21.1; 402/8; 402/60; 402/70; 402/73; 412/38

(58) Field of Search ..... 402/8, 60, 62, 402/66–68, 70, 73, 500, 502; 412/34, 38; 281/15.1, 21.1

(56) References Cited

U.S. PATENT DOCUMENTS 893,212 A * 7/1908 Wheildon ..... 402/66
1,165,305 A * 12/1915 Alexander ..... 402/65
1,331,588 A * 2/1920 Shields ..... 402/66
1,526,673 A * 2/1925 McBee ..... 402/66
4,305,675 A * 12/1981 Jacinto ..... 402/61
2002/0141809 A1 * 10/2002 Higashino et al. ..... 402/8
2003/0138308 A1 * 7/2003 Kiyomi ..... 412/34

FOREIGN PATENT DOCUMENTS

| | | |
|---|---|---|
| JP | 10-13641 | 1/1989 |
| JP | 10-250279 | 9/1998 |
| JP | 2001-10270 | 1/2001 |
| JP | WO 02083428 | * 10/2002 |
| JP | 2002307884 | * 10/2002 |

* cited by examiner

*Primary Examiner*—Monica S. Carter
(74) *Attorney, Agent, or Firm*—Lowe Hauptman & Berner, LLP

(57) ABSTRACT

A binder 10 includes a base 15 formed with through passages 14 that allow binding legs 13 to pass through respectively, movable members 16 which are mounted on this base 15 and located at positions corresponding to the through passages 14 respectively, and an operating section 17 which connects these movable members 16 to each other and operates the movable members 16. Each movable member 16 is provided so as to open/close the respective through passage 14so that, in the state that the through passage 14 is closed, a binding force is given to the binding leg 13. The movable members 16 are synchronously movable between a position where the respective through passage 14 are closed and a position where the same is opened synchronously when the operating section 17 is operated in a predetermined manner.

10 Claims, 15 Drawing Sheets

FASTENER

TECHNICAL FIELD

The present invention relates to a binder, and more particularly, to a binder capable of providing a binding force by bending down the binding legs into the positions along a base.

BACKGROUND ART

Conventionally, as for binders used for a flat file, letter file or the like, a binder of the type shown in FIG. 15 and FIG. 16 is available. A binder 80 of this type comprises a slender base 81 extending in a plate-like shape, through passages 83 (only one of which is partially invisible in FIG. 6) for binding legs 82, the passages including holes formed at two positions in the longitudinal direction of the base 81, a pair of movable members 85,85 which are provided on the upper side of the base 81 and are capable of sliding respectively between a position where the through passage 83 is opened and a position where the through passage 83 is closed, and an operating section 86 which connects these movable members 85,85 to each other and operates the movable members 85. The operating section 86 is provided with hinge sections 87 of thinner part at the positions located toward the respective edges in the longitudinal direction thereof and at the center thereof, and thereby, capable of bending and transfiguring into a diagonal-brace form as shown in FIG. 16. The binder 80 is adapted so as to, when the operating section 86 is pressed downward to make the respective movable members 85,85 move in the direction that both thereof part away from each other, hold the binding legs 82 in the bent posture and provide binding force thereto; on the other hand, when a piece member 86A protruding from the central area of the operating section 86 is lifted up to make the respective movable members 85,85 move in the direction that both thereof come closer to each other, allow the binding legs 82 to be pulled out from the through passages 83.

However, in the binder 80 as described above, when operating the operating section 86, due to the fact that the frictional resistance between the respective movable members 85, 85 and the base 81 and the binding legs 82 changes, or the fact that the direction of the force given to the operating section 86 changes in the process of operation, the respective movable members 85,85 are prevented from moving evenly resulting in such a difficulty that relative position between the through passages 83,83 and the movable members 85,85 is hardly kept symmetrical. Due to this, the respective binding legs 82,82 are prevented from being given with the binding force or being released therefrom at the same timing resulting in such a problem that unnatural force is applied during operating the operating section 86. Further, since the movable members 85,85 and the operating section 86 are constituted of resin molds in many cases, when the base 81 is removed from the binding legs 83, each of movable members 85 parts away from each other due to the elastic force of the hinge sections 87 blocking up the through passage 83 resulting in such an inconvenience as the relevant movable member 85 prevents the operation of inserting the binding leg 82 though the through passage 83 from being carried out smoothly.

DISCLOSURE OF INVENTION

The present invention was made from the viewpoint of the inconvenience as described above, and an object thereof is to provide a binder capable of making each of the movable members move synchronously whereby a binding force can be provided to the respective binding legs and be released therefrom smoothly.

Also, another object of the present invention is to provide a binder capable of keeping the open-posture of the through passages when they are opened whereby the binding legs are allowed to pass through the through passages easily.

In order to achieve above-described objects, according to the present invention, such an arrangement is adopted in a binder comprises a base includining through passages for allowing binding legs to pass through respectively, movable members which are provided at a position corresponding to each through passage respectively and mounted movably along the base, and an operating section capable of operating the movable members, wherein:

each of said movable members is provided so as to open/close said through passage, and is provided so as to applied binding force to the binding legs when the through passages are closed; and each of the movable members is mounted so as to move synchronously between a position where the through passage is closed and a position where the through passage is opened when said operating section is operated in a predetermined manner. According to this arrangement, it is possible to prevent the binding force from being provided to each movable member or released therefrom at different timing, whereby it becomes possible to stabilize the movement of each movable member by the operation of the operating section and to provide a comfortable operation feeling to a user.

According to the present invention, such an arrangement may be preferably adopted in the binder which comprises a means of synchronous movement that moves said each movable member synchronously being provided on said base, wherein the means of synchronous movement moves each movable member while keeping each movable member at a roughly same relative position with respect to the through passage when said operating section is operated in a predetermined manner. According to this arrangement, when the operating section is operated in a predetermined manner, each movable members opens/closes the relevant through passage at the same time, and it enables the binding force to be provided to each binding leg or to be released therefrom at roughly the same time. Owing to this, it allows the operating section not only to be operated without being obstructed but also to move each movable member smoothly.

Further, it is preferred to adapt such an arrangement that the means of synchronous movement is provided with a mechanism that provides a specific resistance when each movable member moves; in other words, a function that prevents the movable members from moving unless an intentional external force is given to the operating section and the movable members. In the case that the arrangement is adapted, in a state that the base is removed from the binding legs, it is possible to keep the open-posture of each through passage, whereby it becomes possible to allow each binding leg to pass through the through passage smoothly and directly without being obstructed by the movable members resulting in a swifter binding operation.

Furthermore, the foregoing means of synchronous movement may have an arrangement such that it comprises a pinion mounted in roughly central area of the base, and racks, which are formed integrally with each of the movable members and are capable of engaging with said pinion.

According to this arrangement, it becomes possible to perform the synchronous movement stably while minimizing the movement error of the movable members, and it becomes possible to keep the open-posture of the through passages reliably by providing movement resistance to the movable members.

Still further, an arrangement is also adopted in the binder, in which the base is formed with positioning means that determine the relative relationship symmetrically between each through passage and the movable member corresponding to the relevant through passage when each of the movable members is assembled on the base. According to this arrangement, it becomes possible to keep the distance between each through passage and the movable member at a predetermined space easily resulting in a simplified assembly operation.

BEST MODE FOR CARRYING OUT THE INVENTION

Embodiments of the present invention will be described below with reference to the drawings.

Figure 1:
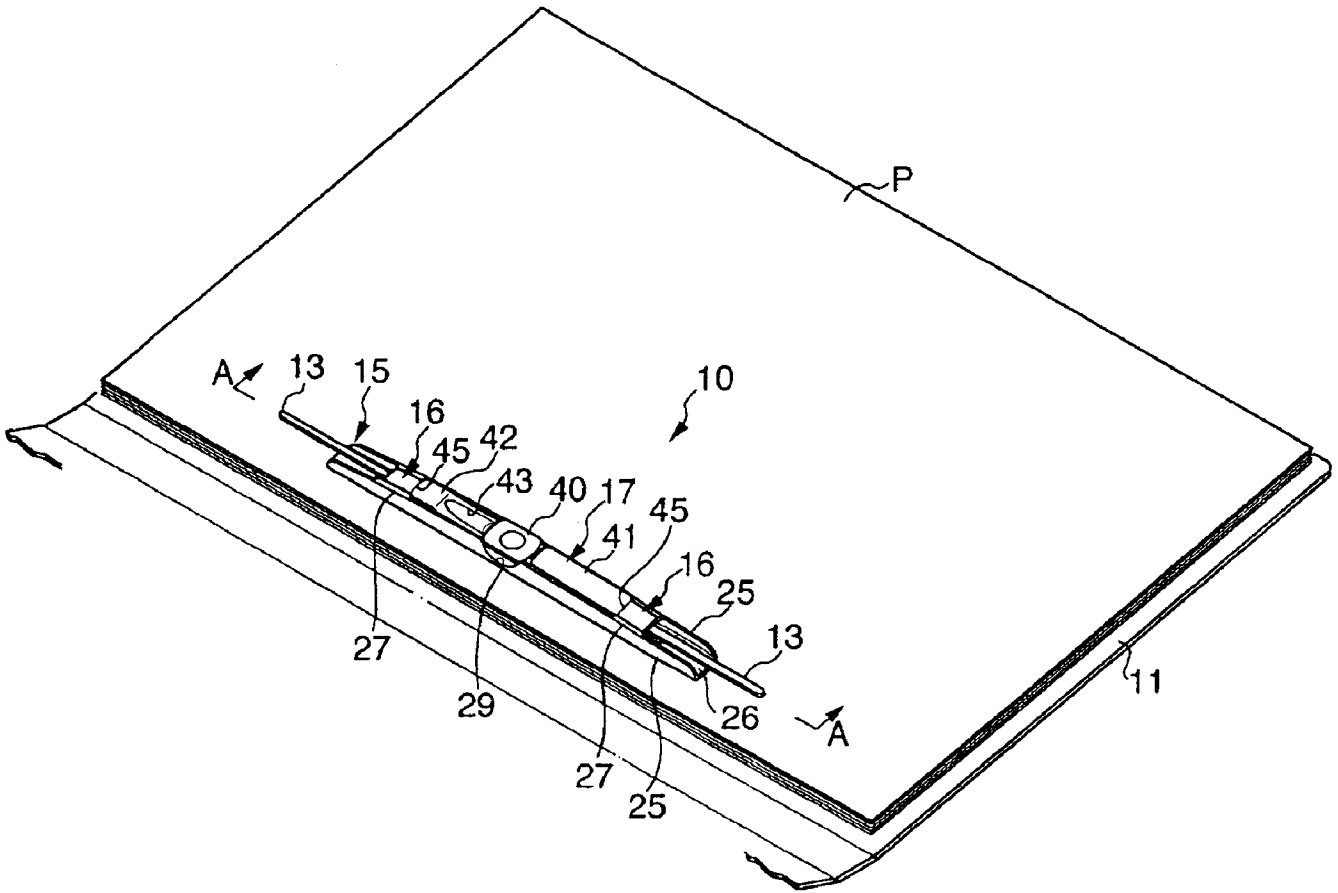
FIG. 1 is a schematic perspective view of a file to which a binder according to an embodiment of the present invention is applied.
Figure 2:
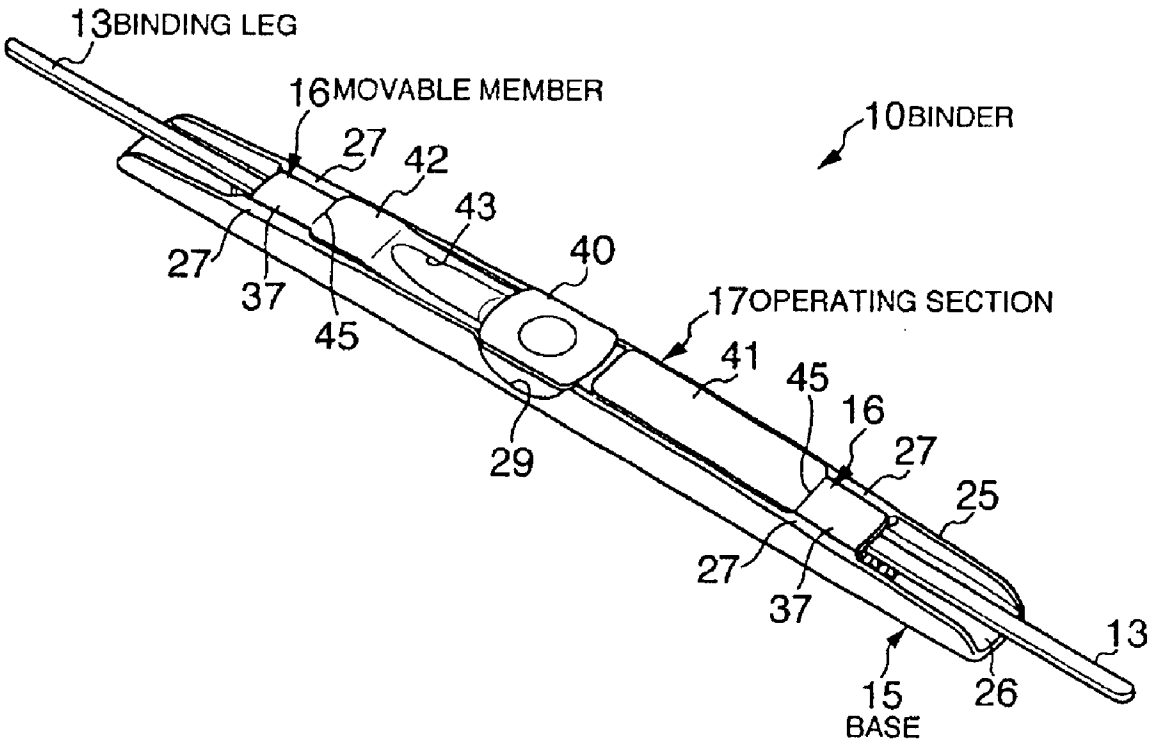
FIG. 2 is an enlarged perspective view of the binder.

In FIG. 1, a schematic perspective view of a binder according to the embodiment, which is applied to a file, is shown; in FIG. 2, an enlarged perspective view of the binder is shown. Also, in FIG. 3, a schematic perspective view of the binder, which is being handled, is shown. Referring to these figures, a binder 10 comprises a pair of binding legs 13,13 mounted to the inner face of a cover body 11, a base 15 formed with a pair of through passages 14,14 for allowing respective binding legs 13,13 to pass through, a pair of movable members 16,16 provided to the upper face side of the base 15 corresponding to the respective through passages 14,14, and an operating section 17 that connects these movable members 16,16 to each other. Further, provided to the upper face of the base 15 is a means of synchronous movement 18 that makes the respective movable members 16,16 perform a synchronous movement.

Figure 3:
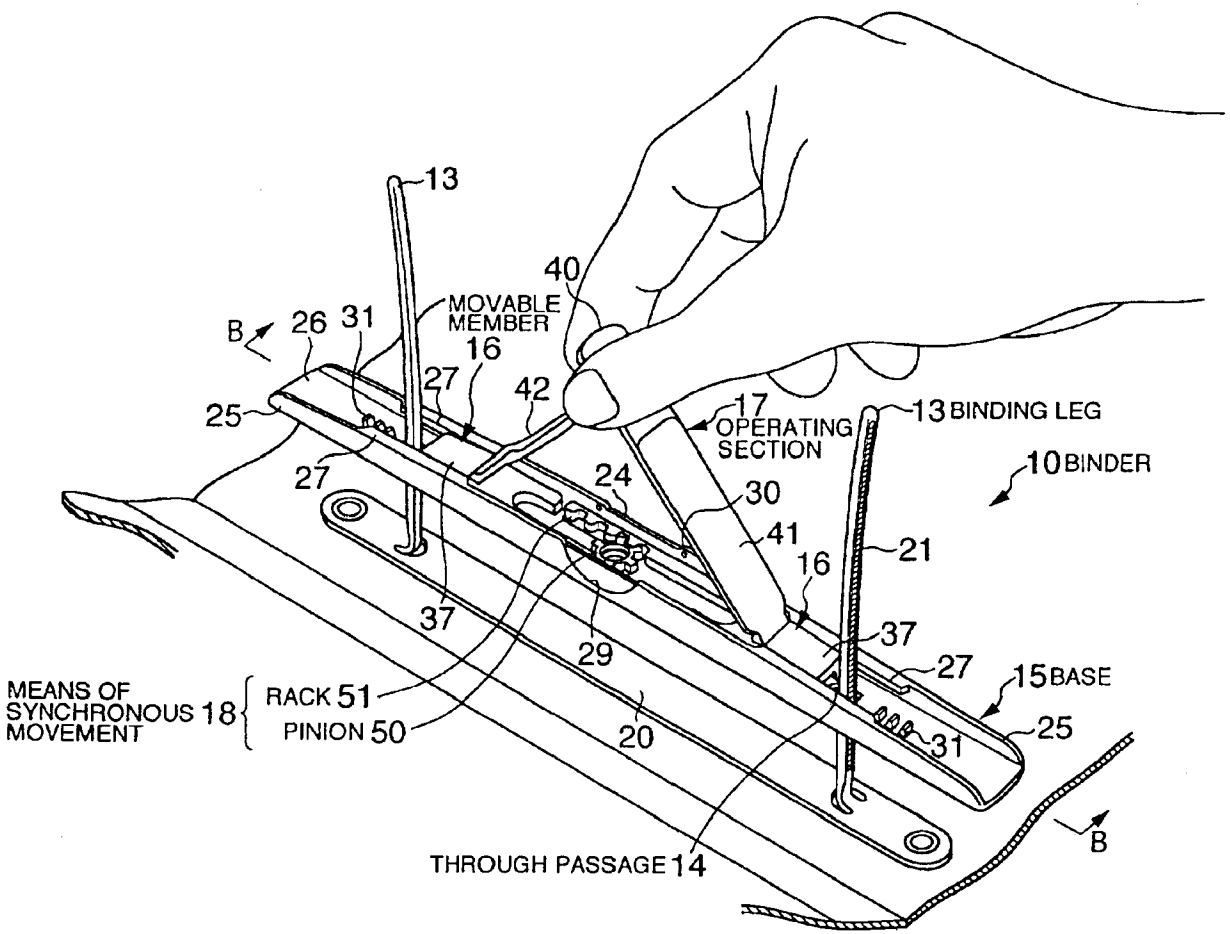
FIG. 3 is a schematic perspective view of the inder being handled.

The binding legs 13,13 are, although not limited particularly to the following, in this embodiment, comprised of cord-shape members, which are formed using a resin material such as polyethylene, and are capable of bending. As shown in FIG. 3, each of the binding legs 13,13 is formed along with a base 20 for the binding legs being connected integrally thereto, which is mounted to the inner face of the cover body 11. Further, as shown also in FIG. 4 and FIG. 5, each of the binding legs 13,13 is provided with a notched face 21 on one face side; i.e., the lower face side when the leg is bent, and thereby, the leg engages with serrate protrusions on the base 15, which will be described later, so that a relative movement between the binding leg 13 and the base 15 may be restricted.

Figure 6:
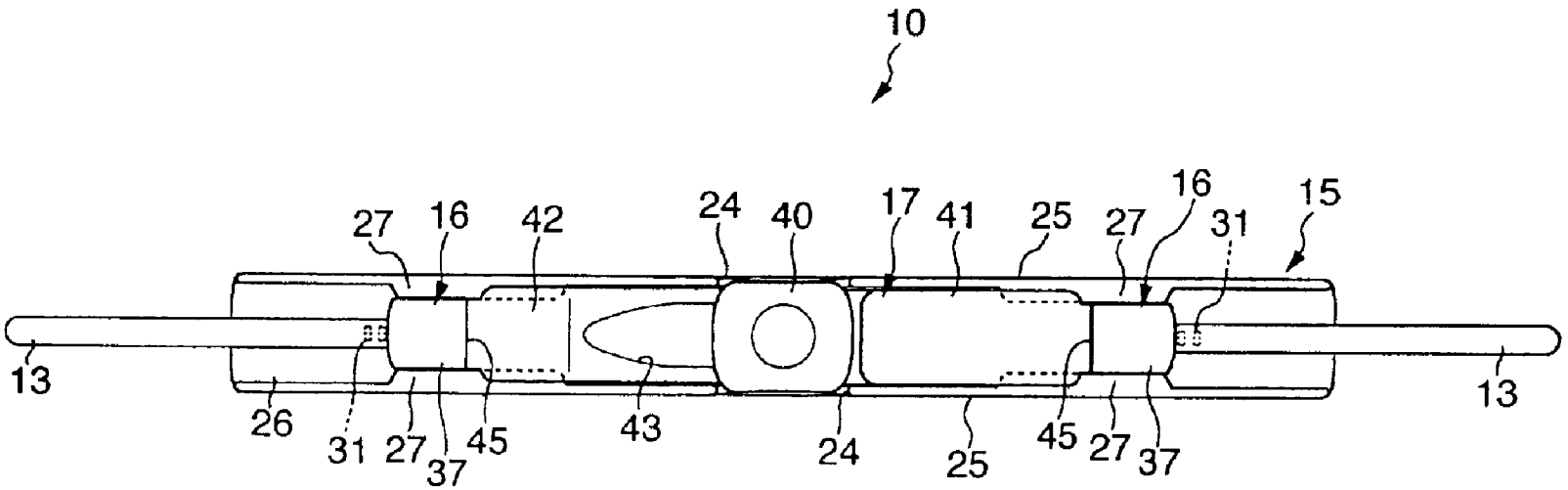
FIG. 6 is a plan view of FIG. 2.
Figure 7:
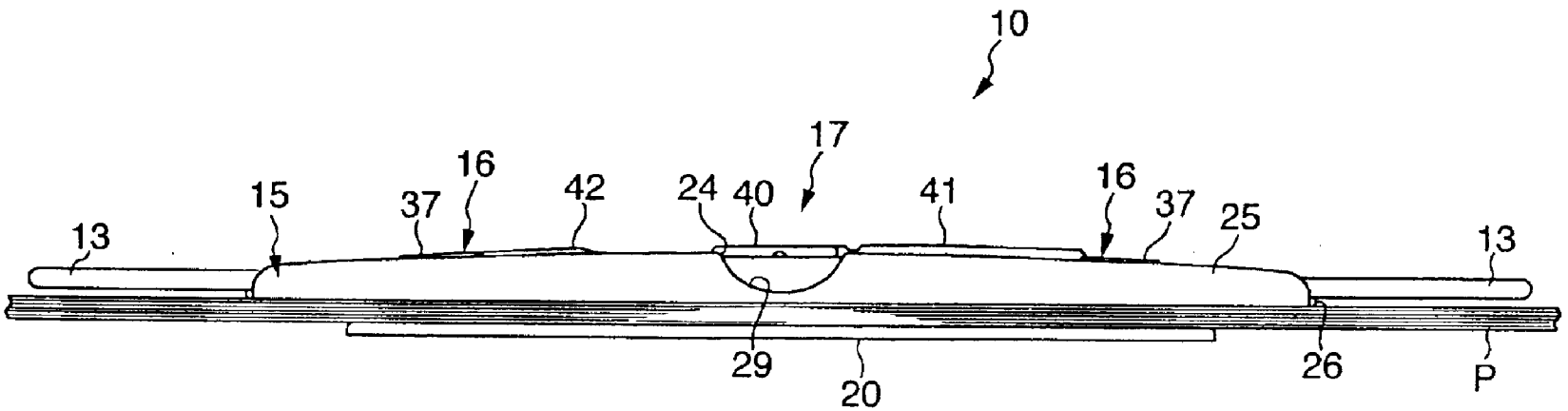
FIG. 7 is an elevation view of FIG. 2.
Figure 8:
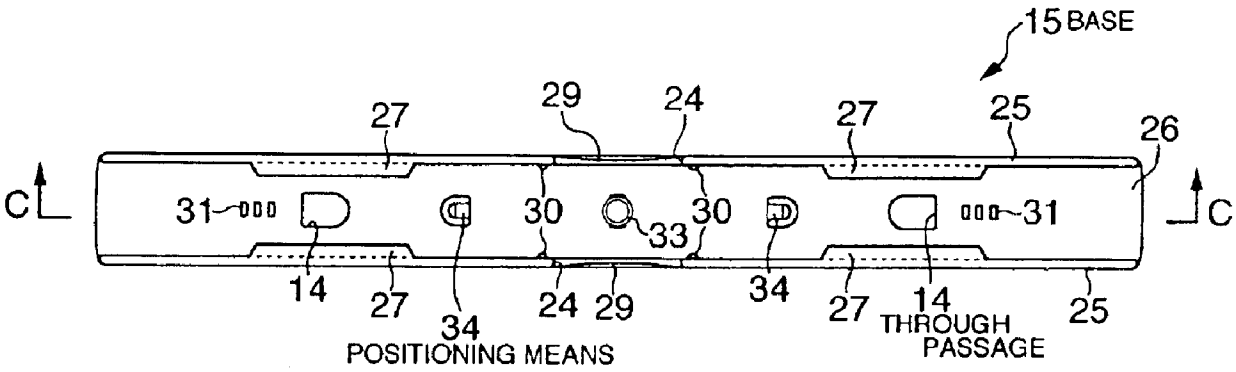
FIG. 8(A) is a plan view of a base.
FIG. 8(B) is a bottom view of FIG. 8(A)
Figure 8:
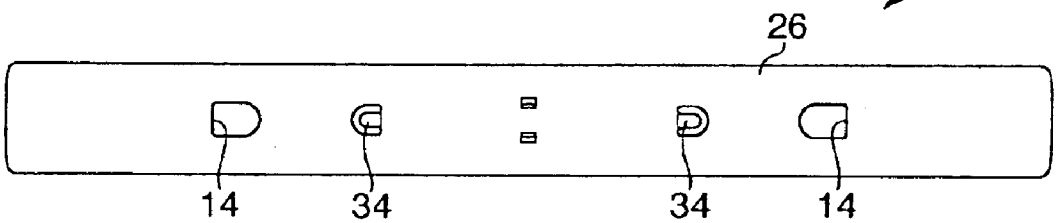

According to the embodiment, the base 15 comprises a mold, which is integrally formed using an appropriate resin material, for example, polypropylene. As shown in FIG. 6-FIG. 12, the base 15 comprises a pair of side walls 25,25 positioned at the both sides in the direction of the narrower width of the binding legs 13 in a state that papers P are bound, and provided with a shallow concave portion 24, respectively, at the upper end in the central area thereof, a base face section 26 formed between these side walls 25,25 and formed with the through passages 14,14 therein, and guide piece sections 27, positioned above the respective through passages 14,14, and formed integrally with the upper end of the respective side walls 25, 25 being oriented toward the inside thereof. As shown in FIG. 7, in the lower-outer face of the concave portion 24 on the respective side walls 25,25, a concave face portion 29 of semicircular shape viewed from the front side is formed respectively; and at the both right and left sides of the concave portion 24 in FIG. 9, on the inner face thereof, protrusions 30 (refer to FIG. 8) capable of engaging with the operating section 17 are provided respectively.

Figure 9:
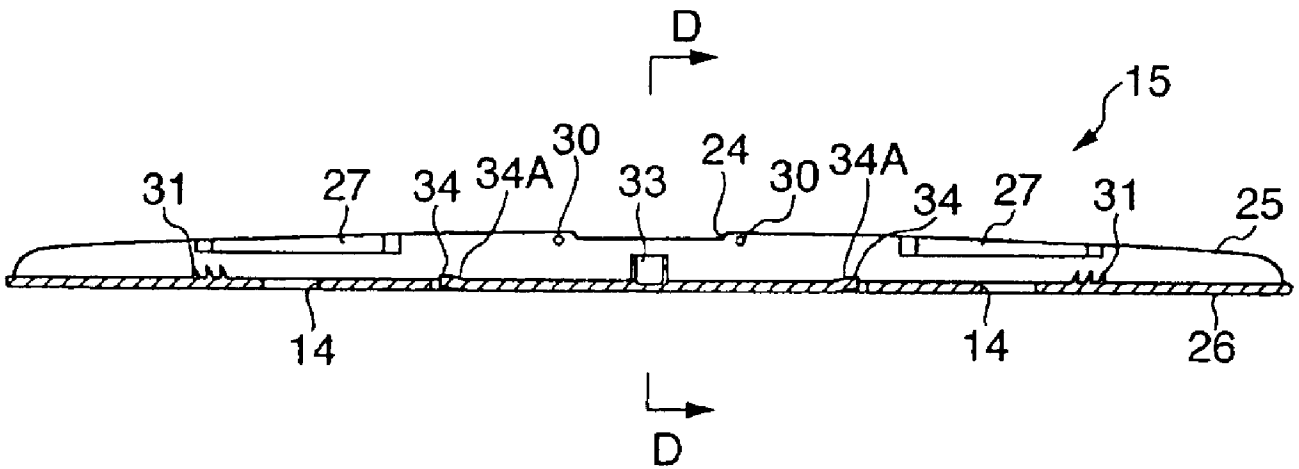
FIG. 9 is a sectional view of FIG. 8(A) taken along the line C—C.
Figure 10:
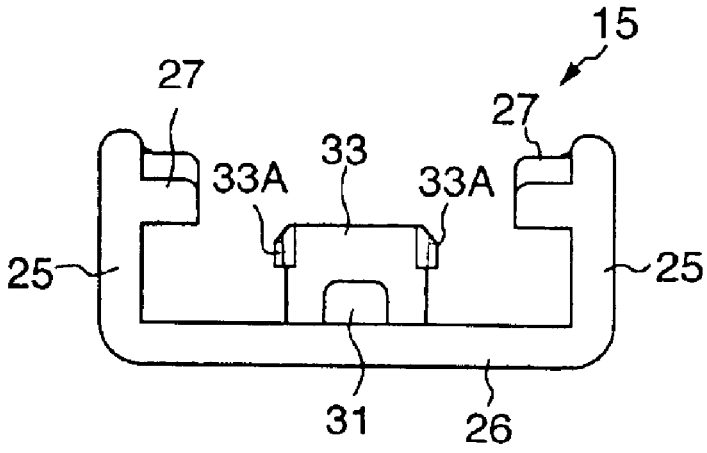
FIG. 10 is an enlarged side view of the base.
Figure 11:
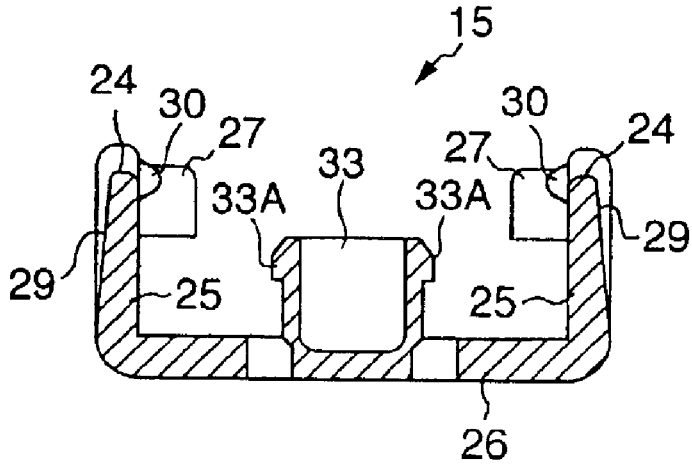
FIG. 11 is an enlarged sectional view of FIG. 9 taken along the line D—D.

As shown in FIG. 8(A) and FIG. 9, the base face section 26 is provided with serrate protrusions 31 at the right and left positions close to the through passages 14 respectively in FIG. 9, a roughly cylindrical supporting section 33 which protrudes from the roughly central area of the base face section 26 and is mounted so as to be capable of supporting a pinion, which will be described later, of a means of synchronous movement 18, and a pair of positioning means 34,34 respectively positioned at a point where is the same distance away from the respective through passages 14,14 toward the center and formed so as to partially and slightly protrude from the upper face of the base face section 26. The respective positioning means 34,34 are formed with a part of the base face section 26 being cut and raised up, and is provided with a sloped face 34A respectively, which lowers toward the center of the base face section 26.

Figure 12:
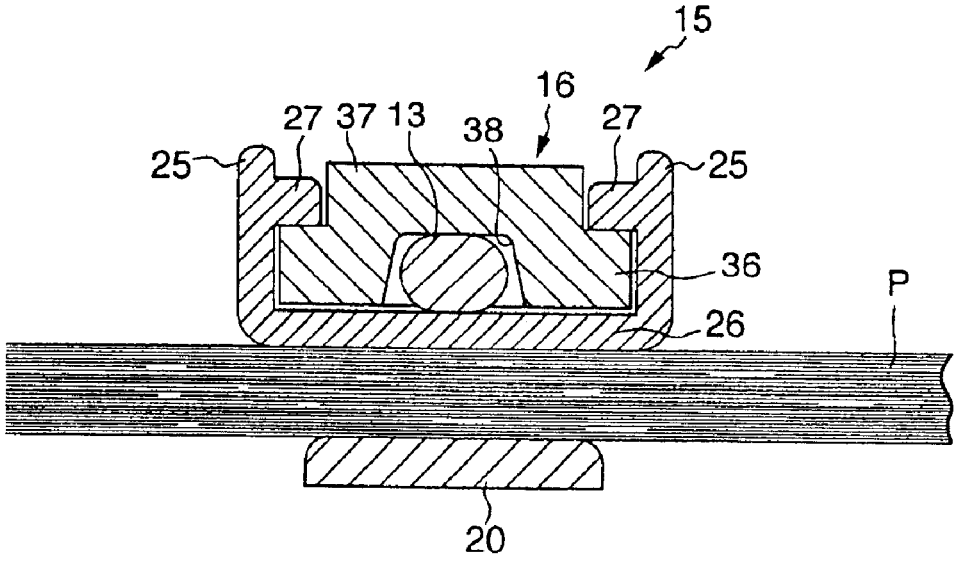
FIG. 12 is an enlarged sectional view of FIG. 4 taken along the line E—E.
Figure 13:
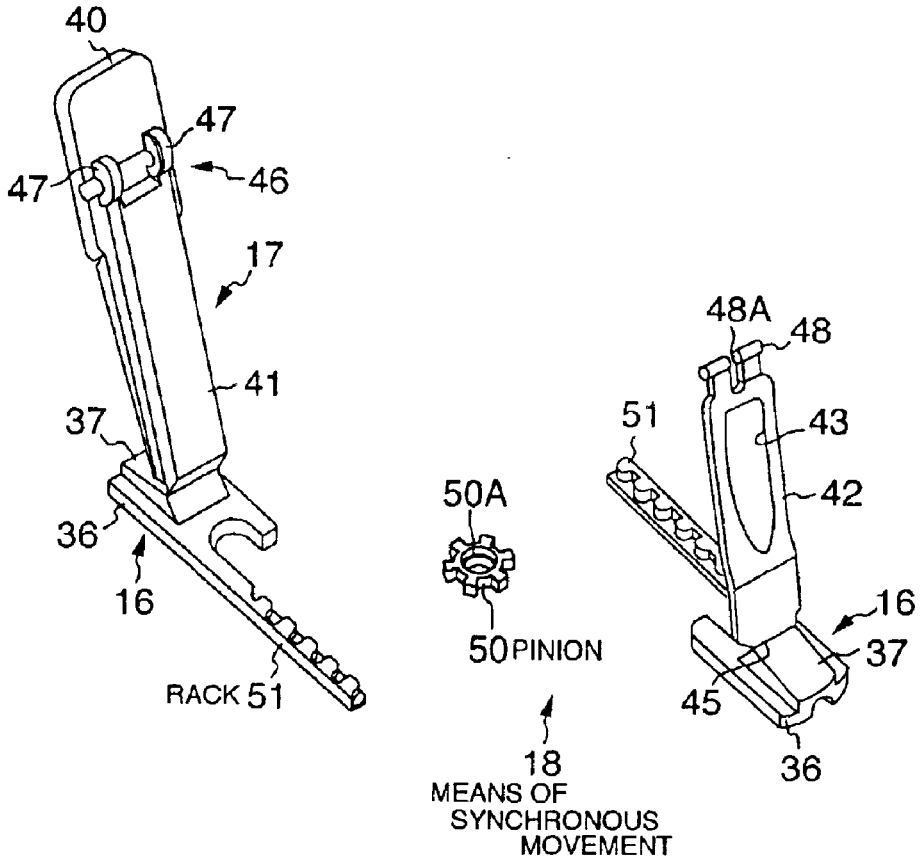
FIG. 13 is an exploded schematic perspective view of movable members, an operating section and a means of synchronous movement.

Each of the movable members 16 is mounted movably to slide along the longitudinal direction of the base 15 so as to open/close the respective through passages 14,14 owing to this slide movement. As shown in FIG. 12 and FIG. 13, each movable member 16 comprises a lower portion forming part 36 formed into a convex-shape having a longer dimension in lateral direction of the section taken along the width direction, and positioned, in particular, between the base face section 26 and the respective guide piece sections 27,27, an upper portion forming part 37 formed on the lower portion forming part 36 integrally therewith, which is positioned between the guide piece sections 27,27, and a receiving section 38 formed into a concave-shape in the bottom side of the lower portion forming part 36 so as to receive the binding leg 13 therein. Accordingly, each of the movable members 16,16 is positioned so as to be enclosed by the base 15, and thereby, it is adapted to allow the movable member to slide to move without floating up away from the base face section 26, and further, it is adopted so as to provide a binding force to the relevant binding leg 13 by sandwiching the binding leg 13 in cooperation with the base face section 26 when the through passage 14 is closed.

Figure 4:
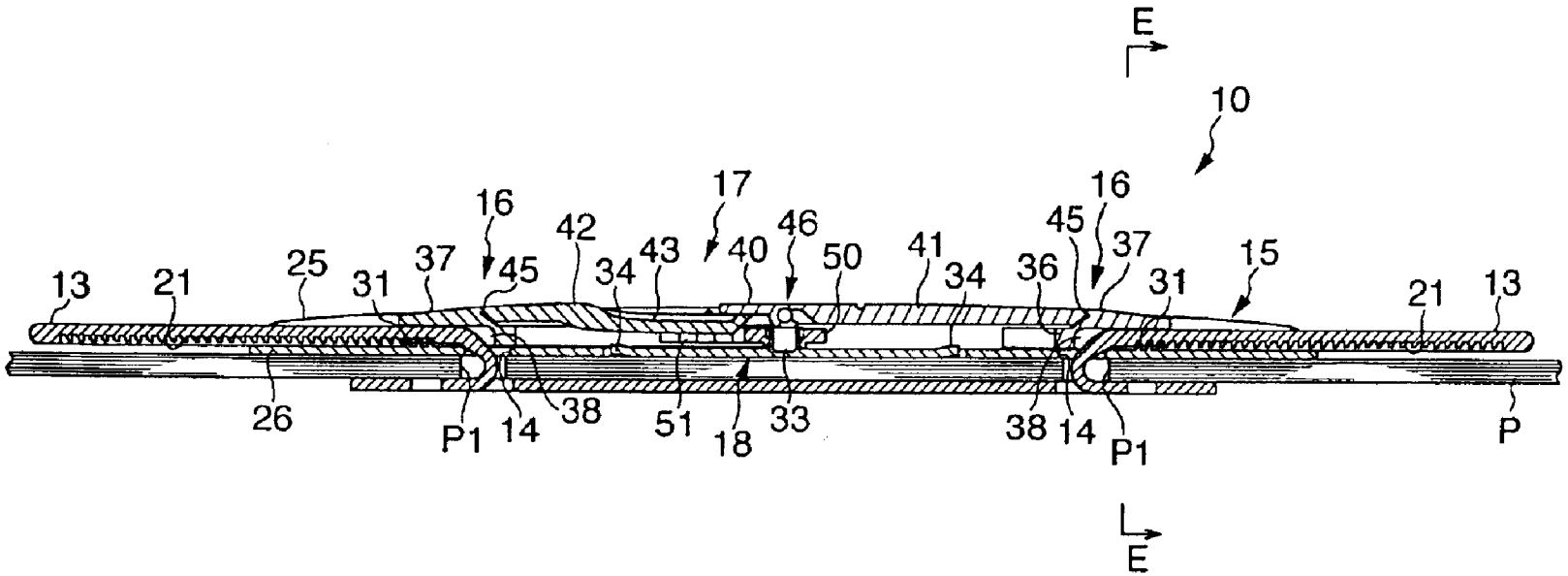
FIG. 4 is a sectional view of the binder taken along the line A—A of FIG. 1.

As shown in FIG. 4 and FIG. 13, the operating section 17 comprises two piece-like members formed integrally with the respective movable members 16,16; i.e., a first operating piece section 41 which is connected with the movable member 16 at the right side in FIG. 4 and is provided with a grip piece 40 at the front end thereof, and a second operating piece section 42 which is connected with the movable member 16 at the left side in FIG. 4. As shown in FIG. 6 and FIG. 7, the grip piece 40 is positioned in the respective concave portions 24,24 in a binding state, and has a slightly smaller dimension in the narrower width than that of the base 15. Further, formed on the upper face of the second operating piece section 42 as shown also in FIG. 4 is a concave area 43 that extends from a point under the grip piece 40 toward the left in FIG. 4.

Figure 5:
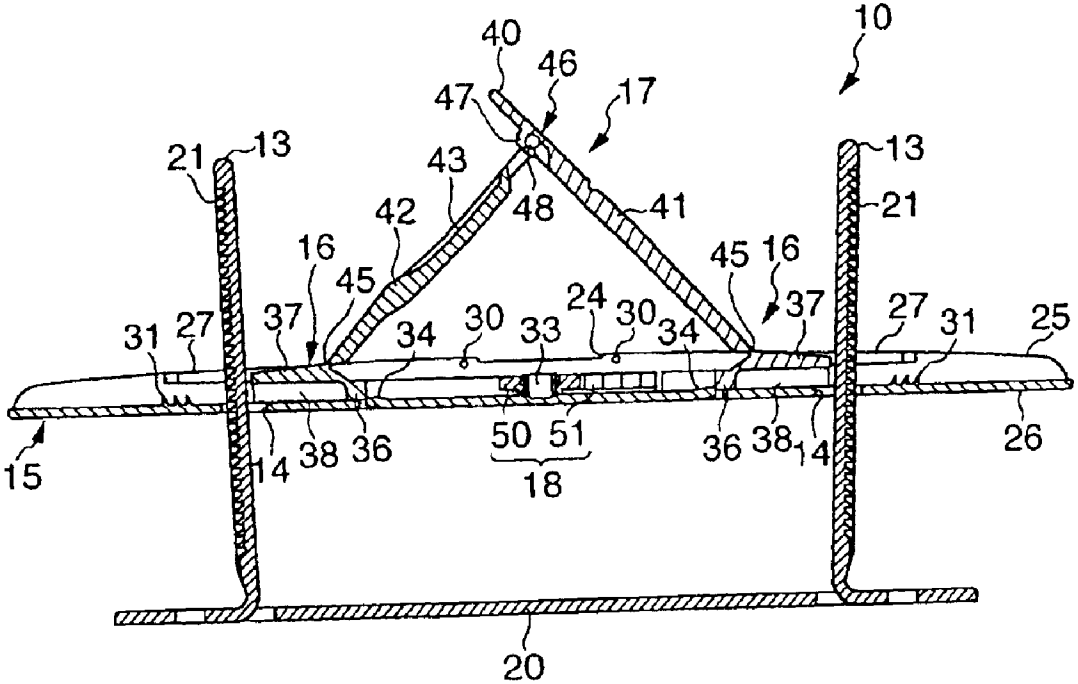
FIG. 5 is a sectional view of the binder taken along the line B—B of FIG. 3.

As shown in FIG. 4 and FIG. 5, the first and second operating piece sections 41,42 are connected to each of the movable members 16,16 via a thin portion 45,45 respectively, and are formed respectively so that the operating piece section is allowed to be bent between a portion thereof that lies along the base and a portion thereof of which front end is oriented upwardly. Further, the front ends of the first and second operating piece sections 41,42 are connected to each other via a hinge section 46. Owing to this, the operating section 17 is adapted so as to, when the grip piece 40 is lifted upward from a state shown in FIG. 4, be bent at the respective points of thin portions 45,45 and the hinge section 46, and each of the movable members 16,16 comes closer to each other being bent and transfigured into a diagonal-brace form. Here, as shown in FIG. 13, the hinge section 46 comprises a pair of bearing sections 47,47, which are formed on the backside of the grip piece 40, and a two-piece type shaft portion 48 which is formed at the front end of the second operating piece section 42 so as to be inserted into the respective bearing sections 47,47, and is formed with a slit 48A at the center thereof; and the hinge section is adapted so that the relevant shaft portion 48 can be inserted into the respective bearing sections 47,47 by nipping the shaft portion 48 to make the width of the slit 48A narrower.

Figure 14:
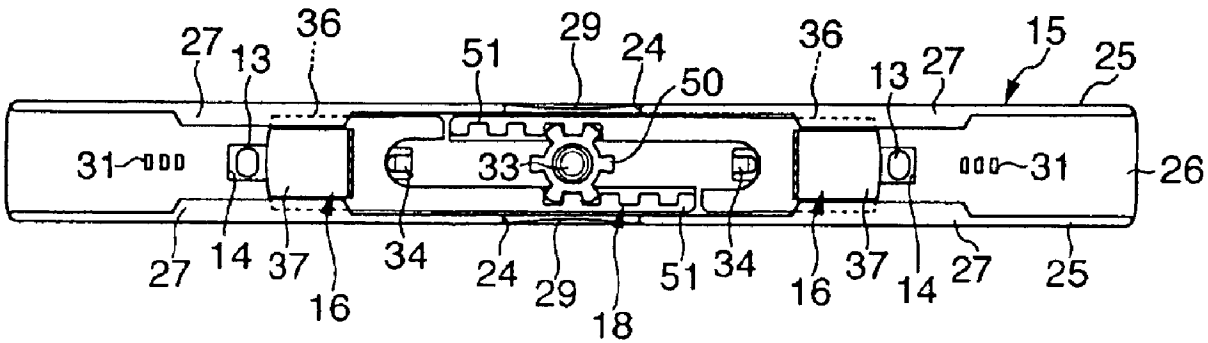
FIG. 14 is a plan view the same as FIG. 3 from which the operating section is omitted.
Figure 15:
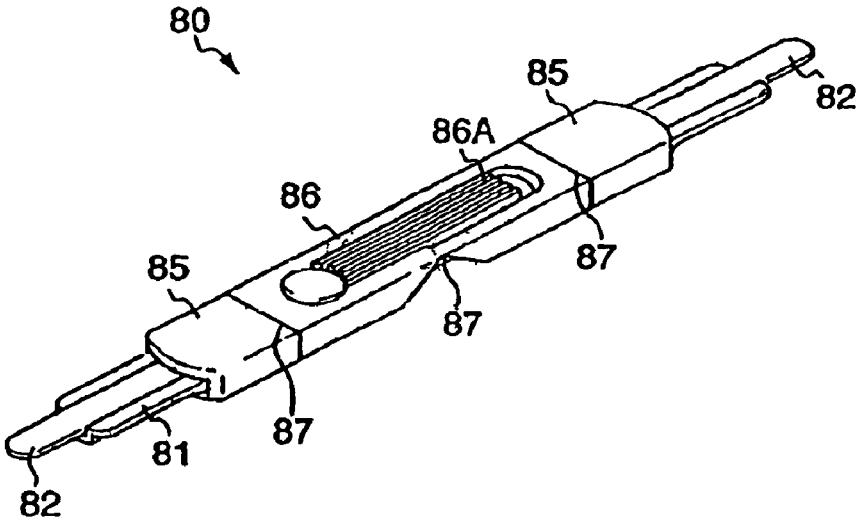
FIG. 15 (PRIOR ART)
FIG. 15 is a schematic perspective view of a conventional binder.
Figure 16:
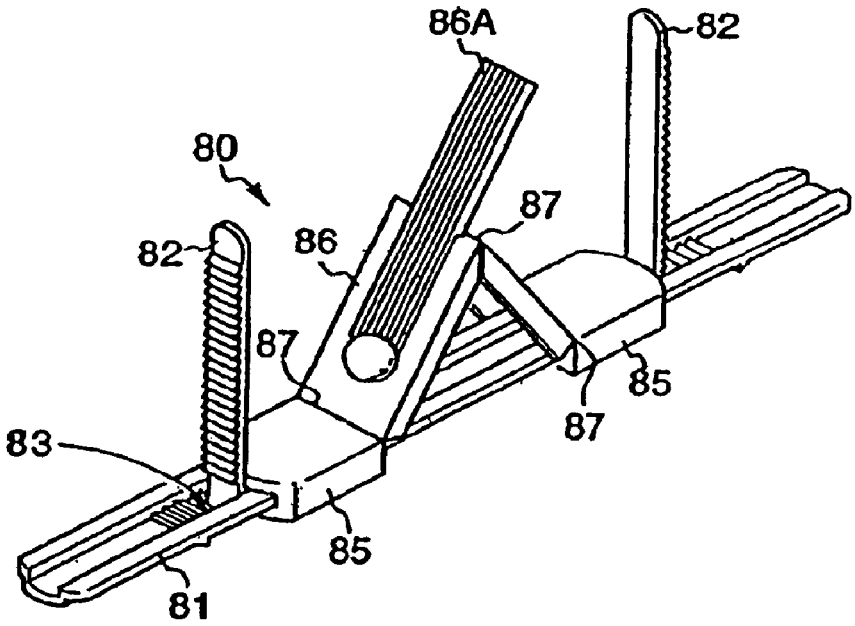
FIG. 16 (PRIOR ART)
FIG. 16 is a perspective view the same as FIG. 15 showing a state in which the through passages are opened.

The means for maintaining synchronous movement 18 is mounted so that, when the operating section 17 is operated, each of the movable members 16,16 can be moved to come closer to each other or to part away from each other at roughly same timing; that is, to perform synchronous movement. As shown in FIG. 3 and FIG. 14, this means of synchronous movement 18 comprises a pinion 50 mounted on the supporting section 33, and racks 51 formed being connected respectively to the inner edge facing thereto of the respective movable members 16 so as to engage with the pinion 50. It is adapted that a frictional resistance is generated between the racks 51 and the pinion 50 so as to prevent slide movement of the movable members 16 unless an external force is given intentionally. Also, as shown in FIG. 13, the pinion 50 is formed with a recessed portion 50A in the inner peripheral face thereof that engages with a pawl section 33A (refer to FIG. 11) formed on the supporting section 33.

Next, a description will be made as to how to assemble the binder 10.

To assemble the binder 10, first of all, each of the movable members 16,16 is inserted from the center of the base 15 between the base face section 26 and the guide piece section 27, respectively. Next, in order to hold each of the movable members 16,16 at a roughly same relative position with respect to the through passages 14 respectively, the inner edges of the respective movable members 16,16, which face to each other, are brought in contact with the respective positioning sections 34,34. In this state, the pinion 50 is mounted onto the supporting section 33, and the pinion 50 and the racks 51,51 are engaged with each other. Here, since each of the positioning sections 34,34 is positioned at a point of the same distance away from the respective through passages 14,14; and is formed at a point with the same distance away from the supporting section 33 respectively, each of the racks 51,51 can be disposed symmetrically with respect to the supporting section 33 as the symmetrical center, and the pinion 50 can be engaged with the racks 51,51 smoothly. And then, as described above, the shaft portion 48 of the hinge section 46 is coupled with the bearing sections 47; thus, the respective operating piece sections 41,42 are connected to each other and the assembly of the binder 10 is completed.

Next, a description will be made as to how to use the binder 10 according to the embodiment.

To bind papers P using the binder 10, first of all, the binding legs 13,13 are inserted respectively into the binding holes P1, P1 of the papers P, and then, the binding legs 13,13 are inserted into each of the through passages 14,14 and then the base 15 is placed on the papers P. At this time, owing to an appropriate frictional resistance of the racks 51 and the pinion 50, the binding legs 13 are allowed to pass trough the through passages 14,14 in a state that each thereof is kept in a open-posture. From that state, by pressing the grip piece 40 downward, each of the movable members 16,16 slides synchronously to move in the direction parting away from each other while keeping each of the movable members 16,16 at a roughly same relative position with respect to each of the through passages 14,14, and a binding force is given to each of the binding legs 13,13 roughly simultaneously. Finally, the grip piece 40 is disposed within the concave portion 24 of the side wall 25, and both side edges of the respective operating piece sections 41,42 and the respective protrusions 30 are engaged with each other preventing the operating section 17 from bending deformation.

On the other hand, the operation to release the binding posture of the binding legs 13 is carried out as described below; that is, from a state shown in FIG. 5, finger tips are positioned to the concave face portion 29 on the respective side walls 25,25 and the grip piece 40 is pinched and lifted up. Owing to this, as shown in FIG. 4, the operating section 17 is bent and deformed at the points of the hinge section 46 and the thin portions 45 respectively; and owing to the effect of the means of synchronous movement 18, each of the movable members 16,16 comes closer to each other synchronously, and each of the through passages 14,14 is opened and the binding force on the binding legs 13,13 is released roughly simultaneously. The grip piece 40 may be lifted up also by inserting a fingertip into the concave area 43 of the second operating piece section 42 and hooking up the back face of the grip piece 40 with the fingertip.

Consequently, according to the embodiment as described above, because the respective movable members 16,16 slide and move synchronously while keeping each of the movable members 16,16 at a roughly same relative position with respect to the through passages 14,14, in addition to that the binding force can be given to the respective binding legs 13,13 and be released therefrom roughly simultaneously, since the grip piece 40 is operated up/down on a specific trajectory with little running off rightward/leftward in FIG. 4, the operating section 17 can be operated smoothly. Furthermore, since the means of synchronous movement 18,comprises the racks 51 and the pinion 50, even when the base 15 is slanted while inserting the binding legs 13,13 through the respective through passages 14,14, or even when the hinge section 46 has elasticity, it enables to prevent reliably the movable members 16 from sliding unintentionally closing the through passage 14.

As for the number of the binding legs 13 and the through passages 14 to be formed is not limited to the constitutional example shown in the figures, but it may be increased as the need arises. In a word, according to the invention, it is acceptable if the respective movable members 16 are adapted so as to move synchronously when opening/closing the respective through passages 14.

As described above, according to the invention, since the movable members, which open/close the through passages and provide a binding force to the binding legs, are provided on the base and the operating section capable of operating these movable members is provided thereto, and since it is made possible to make the movable members move synchronously between the position where the through passages are opened and the position where the same are closed by operating the operating section in a predetermined manner, it is made possible to prevent the timing of providing/releasing the binding force by means of the respective movable members from becoming asynchronously resulting in a stable movement of the respective movable members.

Further, because the means of synchronous movement that makes the movable members move synchronously is provided on the base, and this means of synchronous movement makes the respective movable members move while keeping each of the movable members at a roughly same relative position with respect to the respective through passages, since the binding force is given to the respective movable members and released therefrom simultaneously when the operating section is operated in a predetermined manner, the respective movable members can be moved smoothly and it is made possible to carry out the adding/removing operation of papers easily and swiftly.

Furthermore, since the means of synchronous movement has a function to provide a specific resistance while moving the respective movable members, the open-posture of the respective through passages can be kept in a state that the base is removed from the binding legs; owing to this, it is made possible to insert the binding legs through the through passages smoothly without being obstructed by the movable members.

Still further, since the means of synchronous movement comprises a pinion mounted on the base and racks connected to the respective movable members that engage with the pinion, the synchronous movement of the respective movable members can be carried out smoothly; and it is made possible to keep the open-posture of the respective through passages by providing a resistance against the movement while carrying out the same.

Still furthermore, when the positioning means, which determine symmetrically the relative position between the respective through passages and the movable members corresponding to these through passages, are formed on the base, since it is made possible to keep the distance between the respective through passages and the movable members to a specific space while assembling the movable members to the base resulting in a simplified assembly thereof.

Industrial Applicability

The binder according to the present invention is mounted to the inner face of a cover body constituting a file and is used for binding various kinds of papers.

What is claimed is:

1. A binder, comprises:

a base including a plurality of through passages for allowing the passage of a plurality of binding legs, respectively;

movable members each being provided at a position corresponding to one of said through passages and mounted to be moveable along the base; and an operating section for operating the movable members; wherein each of said movable members is arranged to close and open one of said through passages, and to apply a binding force to the respective binding leg when said through passages are closed; and said movable members, when acted upon by said operating section, move synchronously between a position where the through passages are closed and a position where the through passages are opened.

2. The binder according to claim 1, further comprising means for synchronously moving said moveable members, said means being provided on said base, said means synchronously moving said moveable members while keeping each movable member at a substantially same relative position with respect to the respective through passage when said moveable members are acted upon by said operating section.

3. The binder according to claim 2, wherein said means includes a mechanism that provides a specific resistance when each movable member moves.

4. The binder according to claim 2, wherein said means comprises:

a pinion mounted in a substantially central area of the base, and racks which are formed integrally with the movable members and engage able with said pinion.

5. The binder according to claim 1, wherein said base has positioning means for positioning the movable members and the respective through passages symmetrically with respect to a symmetrical center when movable members are assembled on the base.

6. A binder, comprising:

a plurality of binding legs;

a base including a plurality of through passages for allowing the passage of said binding legs, respectively;

movable members each being provided at a position corresponding to one of said through passages and mounted to be moveable along the base to close and open said respective through passage; and an operating section for operating the movable members;

wherein said movable members, when acted upon by said operating section, move synchronously between a first position where the through passages are closed and a second position where the through passages are opened.

7. The binder according to claim 6, wherein each movable member is at a substantially same relative position with respect to the respective through passage during the synchronous movement of said moveable members between the first and second positions.

8. The binder according to claim 6, further comprising, on said base, a mechanism that provides a predetermined frictional resistance when said movable members move to prevent unintentional movement of said moveable members.

9. The binder according to claim 6, further comprising a pinion mounted on the base, and toothed racks each being connected with one of the movable members and engaged with said pinion, wherein the engagement between said racks and pinion ensures the synchronous movement of said moveable members.

10. The binder according to claim 6, wherein said base has, for each of said through passages, a stop element, said stop elements being spaced equally from the respective through passages and defining physical stops for the movable members during assembly of the movable members on the base.

* * * * *